US007377832B2

(12) United States Patent
Chamberlain

(10) Patent No.: US 7,377,832 B2
(45) Date of Patent: May 27, 2008

(54) ELECTRIC POWERED FLYING WING TOY

(76) Inventor: Mark Spencer Chamberlain, P.O. Box 65167, Shoreline, WA (US) 98155

( * ) Notice: Subject to any disclaimer, the term of this patent is extended or adjusted under 35 U.S.C. 154(b) by 505 days.

(21) Appl. No.: 10/754,738

(22) Filed: Jan. 8, 2004

(65) Prior Publication Data

US 2004/0195438 A1 Oct. 7, 2004

Related U.S. Application Data

(60) Provisional application No. 60/438,736, filed on Jan. 9, 2003.

(51) Int. Cl.
*A63H 27/24* (2006.01)

(52) U.S. Cl. ..... 446/57

(58) Field of Classification Search ..... 446/34, 446/57; 244/45 R, 53 R, 54, 55
See application file for complete search history.

(56) References Cited

U.S. PATENT DOCUMENTS 1,576,913 A * 3/1926 Jones ..... 446/58
D169,864 S * 6/1953 Myser ..... D21/447
3,585,753 A * 6/1971 Purdy ..... 446/57
3,777,395 A * 12/1973 Chang ..... 446/58
3,937,424 A * 2/1976 Meier et al. ..... 244/53 R
3,940,882 A * 3/1976 Mabuchi ..... 446/58
3,985,322 A * 10/1976 Mabuchi et al. ..... 248/554
4,180,221 A * 12/1979 Harris ..... 224/13
4,415,133 A * 11/1983 Phillips ..... 244/53 R
5,374,010 A * 12/1994 Stone et al. ..... 244/12.5
5,810,284 A * 9/1998 Hibbs et al. ..... 244/13
6,568,980 B2 * 5/2003 Barthold ..... 446/36

* cited by examiner

*Primary Examiner*—John Ricci
(74) *Attorney, Agent, or Firm*—Seed IP Law Group PLLC

(57) ABSTRACT

A radio-controlled electrically-powered model flying wing aircraft having a pusher propeller at the rear wing root powered by an electric motor mounted in a streamlined electric motor housing that extends into the wing and blends smoothly into the wing surface at the center wing chord. The motor housing, motor and propeller extend beyond the wing trailing edges to ensure efficient propeller operation and to reduce propeller-induced noise. A battery is secured in a resilient pouch and protected completely inside the wing root, serviceable from the bottom wing surface by removing a quick release flap. Major structural elements are composed of impact resistant, flexible, and resilient materials.

15 Claims, 3 Drawing Sheets

ELECTRIC POWERED FLYING WING TOY

BACKGROUND OF THE INVENTION

1. Field of the Invention

This invention relates to a toy model radio controlled, electric motor propelled flying wing.

2. Description of the Related Art

The flying wing is an aerodynamically efficient aircraft, in part because the entire body provides lift, while the fuselage section of a conventional aircraft introduces parasitic drag and offers little to no lift. Northrup describes basic flying wing theory in U.S. Pat. No. 2,406,506.

Commercially-available radio controlled, electric-motor-propelled toy flying wings have been derived from unpowered flying wings (gliders), typically used for soaring over slopes. The wings of such gliders are typically constructed using resilient EPP (expanded polypropylene) foam, offering light weight and impact resistance. To increase airframe stiffness, one or more spar shafts are embedded inside the EPP wings. The physical arrangement of the spar shaft(s) depends upon the design but could consist of a single shaft extending the major width of the wingspan or as an arrangement of shafts that effectively formed a pattern in the shape of the letter "A".

Flight control of a toy flying wing is generally made possible through the use of two control surfaces (elevons) on the trailing edge of each wing. Servos are coupled to each elevon to actuate the elevon, thereby providing control of the aircraft in flight. Vertical stabilizers (winglets) are typically used at the wingtips for directional stability and to reduce induced drag due to wingtip vortices.

Typically no landing gear is used because these toy craft are hand launchable and can land gently in the grass or can be hand caught.

Slope soaring involves the use of rising wind available at hilly terrain as the principal energy source for climbing. Frequently, such hilly terrain is unavailable or inconveniently located, or the weather conditions are not conducive to slope soaring. Because of this, an electric propulsion system has been added.

An electric motor is secured to the flying wing glider on the center wing chord line, positioned flush with the trailing edge of the wing, with the motor shaft projecting rearward beyond the trailing edge. The motor shaft accepts a pusher thrust configuration propeller. Commonly, but not exclusively used, is an inexpensive electric motor known in the trade as the "Speed 400".

Because the motor is attached directly on top of the wing surface, and the trailing wing edges are swept back, it is necessary to trim the wing trailing edges somewhat in order to provide clear space for the propeller to spin. In operation, the propeller operates very closely to the trimmed trailing edge. This causes propeller thrust inefficiencies because the wing, and in particular, the trailing edge of the wing generates turbulence that interferes with smooth propeller air flow. This configuration also increases the audible noise level generated by the propeller system.

With the introduction of an electric-motor-powered thrust system came the requirement for a larger on-board battery containing sufficient energy to drive the electric motor at a rated speed for a reasonable amount of time. Because the airfoil thickness of original flying wing glider designs does not fully accommodate the larger battery inside the wing, the battery is typically placed on top of, underneath, or is partially embedded into the wing. The battery is typically constructed of multiple dry cells, electrically connected in series. Cell technologies include Nickel Cadmium (NiCD), Nickel Metal Hydride (NiMH), and Lithium ion.

Several commercially-available powered flying wing products use a relatively large thermoplastic fuselage that covers the battery and the motor on the top surface and is secured with small strips of adhesive-backed hook-and-loop tape (generally known as Velcro). Velcro is also the principal means of securing the battery. The disadvantages of this design include substantial interference from the fuselage with airflow to the rearwardly-located pusher propeller. Upon hard nose impact with the earth or a stationary object, the thermoplastic cracks or shatters and the battery, also secured to the plane using Velcro fasteners, can eject from the craft, posing a human safety hazard and potentially damaging the battery and all electronics connected to the battery.

BRIEF SUMMARY OF THE INVENTION

The disclosed embodiments of the present invention are directed to a radio controlled, electric motor propelled flying wing toy incorporating novel features described herein. A pusher propeller thrust system consisting of an electric motor and propeller is inside a streamlined motor enclosure installed to extend beyond the trailing wing edge. The enclosure extends partially or fully into the wing and extends beyond the trailing edge of the aircraft wing. Extending the propeller away from the trailing edge improves propeller thrust efficiency because the propeller encounters less turbulent air and less interference between the propeller-induced turbulence and the trailing edge of the wing. For an aircraft that is flying normally (i.e., non-inverted), airflow tends to delaminate (break up into turbulent airflow) on the top wing surface first, in part because the air pressure is lower on the top wing surface than it is on the bottom wing surface. The flying wing body, as described in this invention, is designed with smooth airfoil contours forward of the streamlined motor enclosure, motor and propeller system, offering superior laminar air flow behavior over a greater portion of the wing, particularly over the top wing surface, upstream of the propeller. The combination of innovations described above results in increased propeller thrust efficiency and reduced audible propeller noise. Increased propeller thrust efficiency is an important benefit because electric propulsion systems in general offer less thrust per unit mass when compared to internal combustion type engines commonly used in the radio control hobby market.

The present invention offers a means of securing the battery pack completely within the wing, accessible from the bottom surface, capable of retaining the battery during high speed aerobatic maneuvers, while retaining a smooth airfoil contour underneath, through the combined implementation of a resilient battery bay pouch, and a flexible cover flap that locks the battery in place and covers the battery bay opening and pouch.

The present invention offers a means of securing the battery in such a fashion that it is not ejected from the craft upon impact, the foam wing structure itself absorbs the kinetic energy of the battery mass upon impact, the battery can be quickly and easily installed and removed, and the combined battery and propulsion system are sufficiently air-cooled during flight.

The aforementioned features are accomplished, in part, while using resilient, impact absorbing wing material, such as flexible closed cell EPP (expanded propylene plastic) foam that substantially returns to its original shape after impact.

In accordance with one embodiment of the invention, a flying wing for use with an electric propulsion system is provided that includes an airfoil having a leading edge, a trailing edge, and a top and bottom surface defining an interior; a battery bay formed within the interior and adapted to completely enclose a battery therein; and a motor enclosure formed to extend from the trailing edge of the airfoil and adapted to enclose an electric motor having a propeller attached thereto. Ideally the motor enclosure is adapted to extend aft of the trailing edge of the wing a predetermined distance to decouple the airfoil trailing edge turbulence from an aft-mounted propeller.

In accordance with another aspect of the foregoing invention, the leading edge of the airfoil is swept back towards the trailing edge at an angle to form a nose portion and to provide installation of a battery in the battery bay aft of the nose portion of the airfoil with shock-absorbing material between the battery and the nose portion of the airfoil while maintaining a balance point that enables the airfoil to achieve sustained flight.

In accordance with another embodiment of the invention, an aerodynamic wing-shaped propelled vehicle is provided that includes an airfoil having top and bottom surfaces that meet at a leading edge and a trailing edge, the leading edge swept back towards the trailing edge to form a nose portion, the airfoil configured to have an arched cross-sectional configuration that provides camber and defines an interior; a battery bay formed in the interior of the airfoil and configured to entirely enclose a battery within the interior of the airfoil; an electric motor coupled to the battery and having a shaft extending therefrom on which is mounted a pusher-type propeller; and a motor mount integrally formed on the airfoil and sized and shaped to receive the electric motor, the motor mount extending aft of the trailing edge of the wing a predetermined distance to position the propeller away from turbulence generated at the trailing edge of the airfoil when in flight.

In accordance with yet another embodiment of the invention, a flying wing is provided that comprises a wing having a leading edge and a trailing edge; and a propulsion system mounted on the wing having a pusher propeller extended aft of the trailing edge of the wing a sufficient distance to decouple the propeller aerodynamically from turbulence generated at the trailing edge of the wing when in flight.

As will be readily appreciated from the foregoing, the disclosed embodiments of the invention provide a more efficient propulsion system, reduce the audible noise produced by the propeller when propeller is engaged, improve the gliding efficiency of the flying wing body as a whole, prevent the propulsion system from overheating, provide an improved means of reliably securing and servicing the battery pack while retaining an efficient aerodynamic wing body shape, and offers an overall design that is impact resistant, and typically remain flyable with little or no repair after sustaining a hard landing.

BRIEF DESCRIPTION OF THE DRAWINGS

The invention will be more readily understood from a reading of the following specification and by reference to the accompanying drawings forming a part thereof, where an example of the invention is shown, wherein.

DETAILED DESCRIPTION OF THE INVENTION

Figure 1:
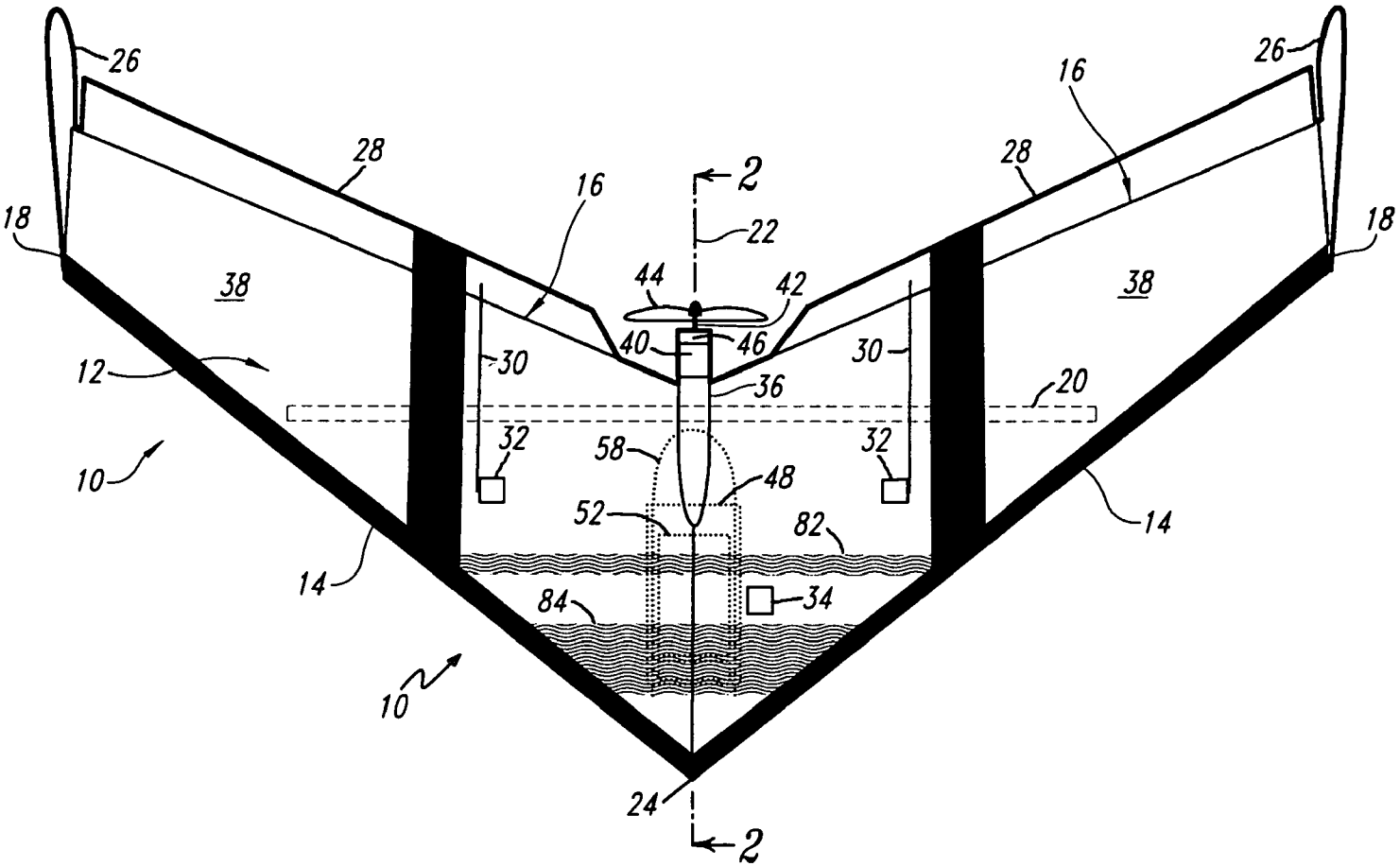
FIG. 1 displays a plan form top view of the flying wing toy embodying the present invention.

Generally, the present invention utilizes a form-fitting motor enclosure, allowing the motor and propeller to extend rearward, while minimizing interference of air flow between the aircraft nose and pusher propeller. The motor enclosure extension combines with the extension of the propeller shaft to position the propeller away from the wing trailing edges.

The net propeller extension improves propeller thrust efficiency and reduces audible propeller noise. Improved thrust efficiency increases aircraft climb rate at full throttle, and allows the operator to continuously cruise the flying wing at lesser throttle, thereby extending flight time before the battery becomes discharged.

Particularly for an aircraft that is cruising normally (i.e., non-inverted), airflow tends to delaminate (break up into turbulent airflow) on the top wing surface first, in part because the air pressure is lower on the top wing surface than it is on the bottom wing surface. The flying wing body, as described herein, is designed with smooth airfoil contours at the aircraft root chord, between the nose and the propeller, offering superior laminar airflow behavior over a greater portion of the wing, particularly over the top wing surface. The pusher propeller further attains smooth airflow, as suction obtains in front of the propeller, causing the flow and flow pattern to straighten so as to permit formation of fairly long and coherent laminar boundary layers reaching the trailing wing edges. These qualities are desirable because glide and thrust efficiency are of particular concern for electric powered aircraft. Electric propulsion systems in general offer less thrust per unit mass when compared to internal combustion type engines commonly used in the radio control hobby market.

The present invention also offers an innovative means of securing and hiding the battery completely within the wing body, accessed by lifting a smooth cover flap on the bottom surface.

The present invention further eliminates the use of thermoplastic or other brittle materials as principal structural components, and offers a means of securing the battery so that it is not ejected from the craft, and the wing body itself absorbs the kinetic energy of the battery upon impact. The battery slips into a resilient pouch, completely embedded within the wing body, accessed from the underside of the wing body. Once the battery is installed, the pouch prevents the battery from substantially moving in any direction except towards the rear battery installation opening. A flexible flap, attached to the front bottom surface of the aircraft, is then pulled over the pouch assembly, securing itself to an exposed hook-and-loop fastener on the battery. This finishes securing the battery so it cannot fall out of the rear battery installation opening. The flap is stretched taut as it is raised to meet the bottom surface of the wing. The tip of the flap attaches to the bottom rear wing surface preferably using a hook-and-loop fastener. The flap covers most of the battery opening, leaving a small open slot on both sides of the flap, coaxial with the wing root chord, to provide for air cooling of the battery pack and propulsion system.

Removing the battery is accomplished by gradually peeling away the flexible flap. The hook-and-loop fastener detaches with least effort when disconnected gradually instead of all at once. Prior battery securing methods typically required a large separation force to detach the battery from the Velcro fastening strips, since both mating Velcro strips were attached to flat surfaces. Although hook-and-loop fasteners such as Velcro are preferred, alternative quick-release fastener technology, such as magnetic, snap and button style fasteners, may be used.

The battery must be properly positioned in order to set the correct aircraft balance point. The final balance point is typically determined during the process of flight-testing. Consistent placement of the battery is accomplished by preparing a resilient foam stop block that inserts inside the battery pouch, ahead of the battery, to serve as a battery stop. The foam stop is cut to the correct size once the correct placement of the battery has been determined, to fill in any remaining space ahead of the battery and to serve in part as a battery shock absorber should the aircraft experience a hard impact.

Referring initially to FIG. 1, shown therein is a plan form top view of a model radio-controlled flying wing aircraft 10 formed in accordance with the present invention. The aircraft 10 is formed of an aerodynamic wing body 12 having a leading edge 14 and trailing edge 16. While the wing body 10 is shown with swept-back leading edges 14, it may be formed to have no sweep at all, i.e., the wing leading edges 14 may be straight from wingtip 18 to wingtip 18. Additionally, the wing body 10 may have a negative sweep, whereby the wingtips 18 sweep ahead of a wing root; however, this arrangement may result in a wing having flight dynamics that are inherently unstable or nearly unstable without on-board computer-assisted flight control. A negative sweep configuration has been found to result in an aircraft that is more aerobatically responsive than a conventional straight or swept-back wing.

The wing 12 includes an elongated wing stiffening spar 20 mounted inside the wing 12 transverse to the longitudinal axis 22 that is coincident with the sectional view lines 2-2 along the wing root chord that terminates at the nose 24 of the wing body 12.

Wingtip vertical stabilizers (winglets) 26 are mounted on each wingtip 18. Hinged elevon control surfaces 28 are mounted at the trailing edge 16 of the wing body 12 and have servo elevon linkage assemblages 30 coupling the elevons 28 to servos 32 that actuate the elevons 28. The servos 32 are coupled to a radio control receiver 34 that receives radio frequency signals from a transmitter (not shown).

A nacelle 36 is formed on a top surface 38 of the wing 12 and is sized and shaped to enclose an electric motor 40 that turns a shaft 42 having a pusher propeller 44 attached thereto. An optional gear transmission 46 can be used to couple the motor 40 to the propeller 44.

Figure 2:
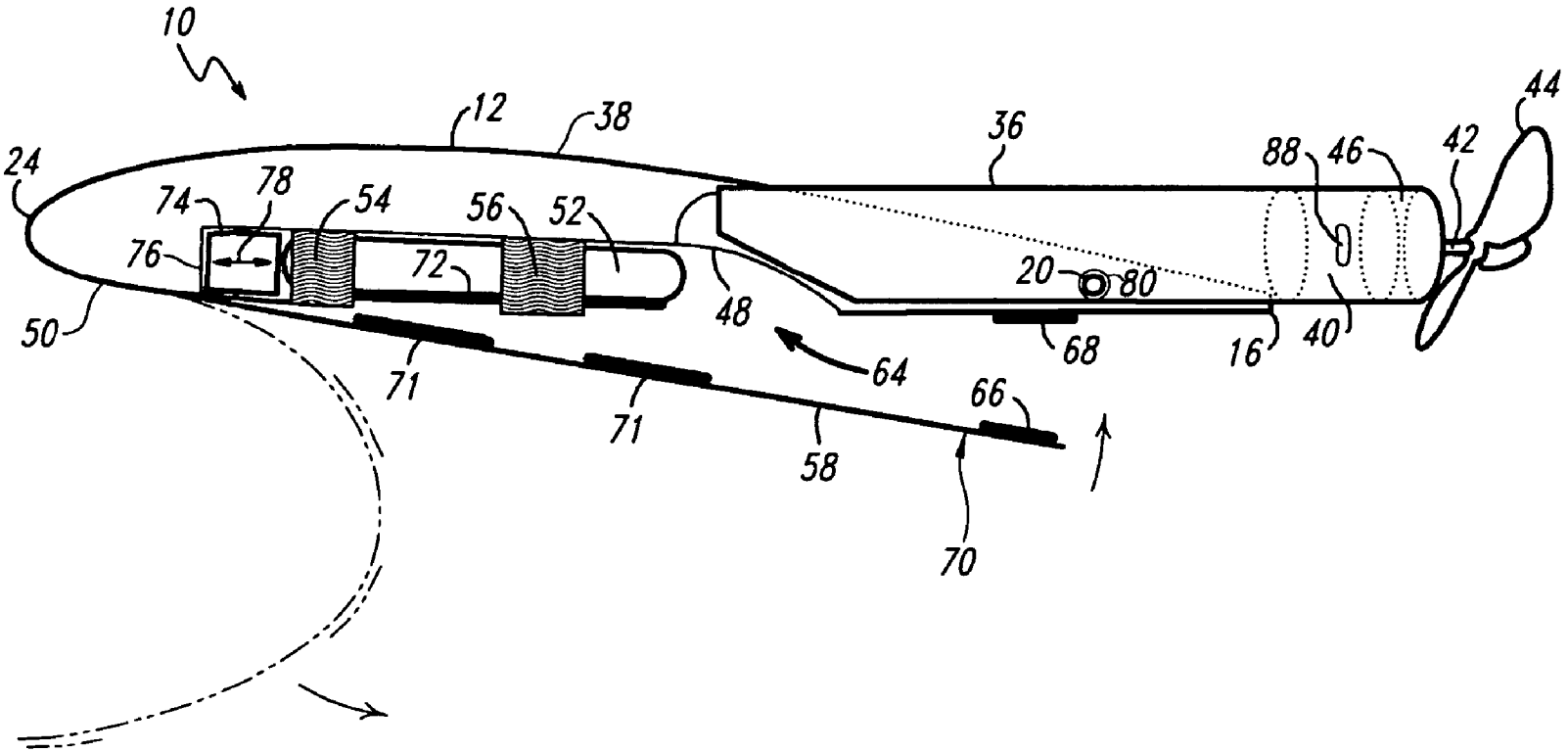
FIG. 2 is a side view taken along section line 2-2 at the aircraft center chord of the wing of FIG. 1, illustrating the placement of the battery, battery bay, battery bay cover flap, streamlined motor enclosure, and propulsion system.
Figure 3:
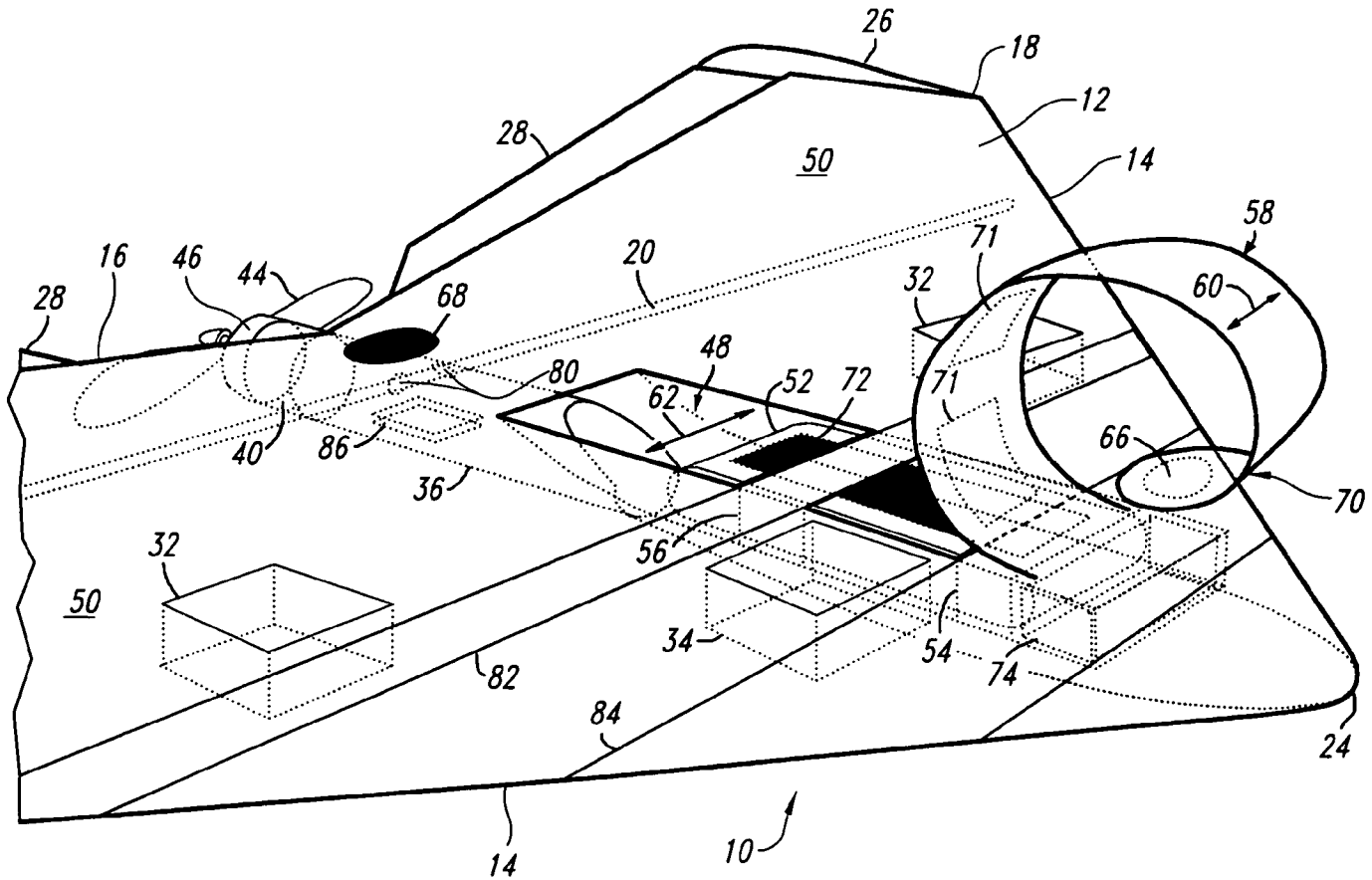
FIG. 3 is a bottom isometric projection of the flying wing toy, illustrating the battery bay design and battery bay flap cover.

As shown more clearly in FIGS. 2 and 3, a battery bay 48 is formed inside the wing 12 that opens to a bottom surface 50 thereof. The battery bay 48 is sized and shaped to receive a battery 52 that is electrically coupled to the radio receiver 34, servos 32, electric motor speed controller 86, and electric motor 40 to provide power thereto. Restraining members 54 and 56 retain the battery 52 inside the battery compartment 48. The restraining members 54, 56 can be formed of filament strapping tape or other equivalent material having similar or better characteristics and strength to form closed loops to allow the battery 52 to be slideably received therein.

A battery compartment flap 58, preferably formed of flexible material such as polycarbonate, vinyl, or acetate plastic sheet, is attached to the bottom surface 50 of the wing 12 or integrally formed therewith. The flap 58 is formed to have a length that extends beyond the length of the battery bay 48 but a width 60 that is less than the width 62 of the battery bay 48 resulting in a narrow exposed surface slot opening on both sides of the battery bay 48.

The battery bay cover 58 is held in place on the bottom surface 50 of the wing 12 by mating components of hook-and-loop fasteners 66, 68 mounted to the trailing edge 70 of the cover 58 and the underside 50 of the wing 12, respectively. In addition, mating components 71, 72 are formed on the battery cover 58 and the battery 52 to attach the battery cover 58 to the battery 52, which not only holds the battery cover 58 in place but also retains the battery 52 in its mounting position inside the battery compartment 48.

The longitudinal position of the battery 52 is adjusted to fine tune the aircraft balance point in order to obtain optimal flight characteristics. With the battery 52 set in an optimal position, a spacer 74 is positioned between the forward end 76 of the battery compartment and the battery 52. The thickness 78 of the spacer 74 is chosen in order to fill the void between the leading edge 76 of the battery compartment 48 and the battery 52. Ideally, the spacer 74 is formed of compressible material to absorb the shock of an impact and prevent damage to the wing 12 and the battery 52.

The overall plan form shape of the wing 12, including the sweep angle of the leading edge 14 and the trailing edge 16, is crafted in part to ensure that (1) the balance point of the aircraft's center of gravity can be adjusted without the need to add ballast weight by changing the position of the battery 52 inside the battery bay 48, and (2) the battery 52 can be positioned sufficiently aft of the nose 24 to provide battery shock absorption via the spacer 78 in the event of a nose collision.

The propulsion system, consisting of the electric motor 40 and propeller 44, along with the optional gear transmission 46, is embedded in a streamlined enclosure that replaces the prior art center fuselage body and other obstructions that interfere with smooth airflow across the top surface 38 and bottom surface 50 of the wing 12 towards the propeller 44. This reduces the disruption of airflow in advance of the propeller 44 to improve propeller thrust efficiency, reduce propeller noise, and increase overall propeller performance.

The aft-ward extension of the propeller housing 36 and the extension of the propeller shaft 42 are both dimensioned to provide substantial set-back clearance of the leading edge of the propeller 44 from the trailing edge 16 of the wing 12 in order to increase propulsion efficiency of the propeller 44. The minimum acceptable propeller set-back distance depends principally on the propeller's material, shape, and rotational speed. In one embodiment of the invention, a simple rule-of-thumb formula can be used to obtain a minimum decoupling distance between the propeller 44 and the trailing edge 16 of the wing 12. If the wing trailing edge 16 is parallel to the propeller's plane of rotation, the average set-back distance is simply the measured distance from the wing trailing edge 16 to the propeller leading edge. In the case of a swept back trailing edge, the average set-back distance must be calculated. In general, this should be at least 20% of the diameter of the propeller 44.

For example, a five-inch diameter propeller should be positioned at least one inch, on the average, from the trailing edge 16 of the wing 12.

To obtain optimal performance, the following design features should be implemented. The spar stiffener 20 is embedded inside the wing 12 to reduce wing flexure during normal flying operation. In a preferred embodiment, two holes 80 (shown in phantom in FIG. 3) are drilled in the nacelle 36 to enable the spar 20 to pass therethrough. The nacelle 36 may include one or more motor air vents 88 (shown in FIG. 2) having locations specific to the particular design of the motor 40 to provide cooling therefore.

In constructing the battery bay 48, the wing body 12 is first prepared by spraying a layer of appropriate contact adhesive spray on the bottom surface 50. Subsequently, the restraining members 54, 56 are prepared as closed loops and fastened completely around the inside of the battery bay 48 and dimensioned such that the battery 52 can later slip therethrough. Additional filament strapping tape or similar material 82, 84, is applied across the bottom surface 50 of the wing 12 to adhere to the restraining members 54, 56, respectively, thus forming a fortified yet resilient enclosure for the battery 52 with the object of retaining the battery 52 inside the battery bay 48 during high acceleration maneuvers or hard landings. Additional filament tape can be optionally added around the perimeter of the battery bay 48 to further fortify the restraining members 54, 56 in order to distribute any impact stress across a greater surface area.

In placing the hook-and-loop fastener on the battery 52 and the cover 58, the hook-and-loop fastener material is cut to length in order to span nearly the full length of the battery 52. The sticky adhesive side of the fastener material 72 is attached to the battery 52. Ideally, the battery spacer 74 is formed of a typical piece of EPP foam block and is first inserted through the battery bay opening 64 and positioned against the leading edge 76 of the battery bay as shown in FIG. 2. The battery 52 is subsequently inserted through the opening 64 with the attachment portion of the hook-and-loop fastener 72 facing outward from the battery bay 48 and slid through the two restraining member loops 54, 56.

As previously stated, and as shown more clearly in FIG. 3, the battery 52 is secured inside the battery bay 48 using a combination of straps composed of filament tapes 82, 84 and the restraining member loops 54, 56, as well as the battery cover 58. The radio control receiver 34 is installed to one side of the battery bay 48, and the two radio control servos 32 are electrically connected to and controlled by the radio control receiver 34. These are installed outboard the flying wing body 12 and embedded inside the wing 12. They are mechanically linked to the hinged elevons 28 in order to control the position of the elevons. An electronic speed controller 86 is electrically connected to the radio control receiver 34. The electronic speed controller 86 electrically modulates the average amount of power supplied to the electric motor 40, thus serving as the propulsion system throttle control.

While not shown, the wing body optionally may incorporate a three-point landing gear assembly attached thereto for use in taking off and landing of the aircraft 10. The landing gear may include wheels, skids, and water pontoons, or any combination thereof. The landing gear may be permanently affixed or they may partially or fully retract into the wing body when not deployed for takeoff or landing.

While preferred embodiments of the invention have been illustrated and described in detail herein, it is to be appreciated that various changes and additions may be made therein without departing from the spirit and scope of the invention. Hence, the invention is to be limited only by the scope of the claims that follow and the equivalents thereof.

The invention claimed is:

1. A propulsion system for an electric powered flying wing toy, the flying wing having a wing body with a nose and trailing edge, comprising:

an electric motor powered pusher propeller mounted aft of the trailing edge;

a minimal profile motor enclosure having no horizontal stabilizers and that form-fits to the shape of the electric motor in order to maximize the cross section of smooth air presentable to the propeller, the motor enclosure adapted to extend aft of the trailing edge a predetermined distance that decouples airfoil trailing edge air turbulence from the aft-mounted propeller, the predetermined distance comprising a minimum distance of 20% of the diameter of the propeller; and a smooth, streamlined, featureless top surface between the flying wing nose and pusher propeller having the effect of minimizing obstruction of air upwind of the propeller and maximizing smooth laminar air flow over the wing body; said smooth wing airflow being further improved owing to the effect of partial vacuum between the propeller and the nose when the pusher propeller is engaged.

2. The system as set forth in claim 1 wherein the propeller is extended a sufficient distance aft of a trailing edge of the wing, in order to effectively decouple propeller-induced air turbulence between the propeller and the wing trailing edge, with the effect of increasing propeller efficiency, reducing audible propeller noise, and reducing mechanical propeller vibration and stress for the intended flight performance envelope.

3. The system as set forth in claim 2 wherein aft propeller extension is deployed by extending the minimal profile motor enclosure aft of the trailing edge.

4. The system as set forth in claim 2 wherein aft propeller extension is deployed by extending a propeller shaft length.

5. A system for securing a battery module within an electric motor powered swept flying wing toy aircraft having a wing body with a leading edge and a trailing edge, the system comprising:

a battery bay embedded completely inside the wing body and having a battery bay opening formed in a bottom side instead of a topside of the wing body to allow a featureless top surface of the wing body for minimizing interruption of laminar air flow on the top surface of the wing body;

a hook-and-loop battery fastener attached to the surface of a battery module that will be exposed and visible when the battery module is properly installed into the battery bay;

the battery module, when installed in the battery bay, is prevented from falling out of the battery bay through the use of two or more straps placed perpendicular to the wing chord, with spacing in between the straps to accommodate at least one hook-and-loop fastener member;

one edge of a thin, resilient, flexible battery bay cover flap permanently attached to an underside of the wing body between the nose and the battery bay and dimensioned and positioned to cover the battery bay opening in the wing body;

at least one hook-and-loop fastener member attached to an inside surface of the battery bay cover flap, the fastener member dimensioned and positioned in order to mate against exposed portions of the battery module hook-and-loop fastener member when the battery bay cover flap swings to cover the battery bay opening;

a hook and loop fastener member is attached to the battery bay cover flap near an opposite, unsecured edge of the battery bay cover flap that in turn mates to a corresponding hook-and-loop fastener member fixed to the bottom side of the wing body between the wing trailing edge and the battery bay opening;

with the battery module installed, the battery bay cover flap is lightly stretched as it is secured to the mating hook-and-loop fastener member on the battery module as well as on the bottom side of the wing body;

the battery module is hence locked in place so it cannot slide laterally within the battery bay, and the battery bay straps instead of the hook-and-loop fasteners will primarily absorb the principal forces acting on the battery in flight and during impact; and removal of the battery is accomplished by peeling the battery bay cover flap away from the mating hook-and-loop fasteners.

6. The system as set forth in claim 5 wherein the wing sweep is chosen to allow the battery module to be installed aft of the wing nose with sufficient spacing between the wing nose and the battery to provide battery impact absorption while maintaining a balance point that allows the aircraft to fly in a stable attitude.

7. The system as set forth in claim 5 wherein the battery module position is adjustable within the battery bay toward the front or rear of the aircraft for fine-tuning aircraft balance or accommodating balance point shifts due to wing span shortening or other aircraft modifications.

8. The system as set forth in claim 5 wherein a resilient foam stop block is inserted into the battery bay before the battery module is inserted in order to fill any air cavity that may be present with the battery having been repositioned to set the optimal aircraft balance point.

9. The system as set forth in claim 5 wherein the width of the battery bay cover flap is made slightly narrower than the battery bay width to allow for air flow into the battery bay to cool the battery module.

10. The system as set forth in claim 5 wherein resilient battery bay strap materials are used in order to absorb shock incurred upon hard impact.

11. The system as set forth in claim 10 wherein the resilient material used is filament tape with contact adhesive spray that has been previously applied to surfaces where filament tape is to be applied for maximum filament tape adhesion strength.

12. A flying wing for use with an electric propulsion system, comprising:

an airfoil having a leading edge, a trailing edge, and top and bottom surfaces defining an interior, the airfoil having no fuselage or horizontal stabilizers;

a battery bay formed within the interior and adapted to completely enclose a battery therein; and a motor enclosure formed to extend from the trailing edge of the airfoil and adapted to enclose an electric motor, the motor enclosure adapted to extend aft of the trailing edge a predetermined distance that decouples airfoil trailing edge air turbulence from an aft-mounted propeller, the predetermined distance comprising a minimum distance of 20% of the propeller diameter;

wherein the leading edge of the airfoil is swept back towards the trailing edge at an angel to form a nose portion and to enable installation of a battery in the battery bay aft of a portion of the airfoil while maintaining a balance point that enables the airfoil to achieve sustained flight.

13. An aerodynamic wing-shaped propelled vehicle, comprising:

an airfoil having top and bottom surfaces that meet at a leading edge and a trailing edge, the leading edge swept back towards the trailing edge to form a nose portion, the airfoil configured to have an arched cross-sectional configuration that provides camber and that defines an interior;

a battery bay formed in the interior of the airfoil and configured to entirely enclose a battery within the interior of the airfoil;

an electric motor coupled to the battery and having a shaft extending therefrom on which is mounted a pusher-type propeller; and a motor mount integrally formed on the airfoil and sized and shaped to receive the electric motor, the motor mount extending aft of the trailing edge of the wing a predetermined distance to position the propeller away from turbulence generated at the trailing edge of the airfoil when in flight.

14. The vehicle of claim 13, comprising a battery module sized and shaped to be received within the battery bay, the battery module comprising a battery and means for retaining the battery inside the battery bay.

15. The vehicle of claim 14, comprising a flap for covering the battery bay without interfering with the aerodynamics of the airfoil.

* * * * *

UNITED STATES PATENT AND TRADEMARK OFFICE

CERTIFICATE OF CORRECTION

PATENT NO. : 7,377,832 B2
APPLICATION NO. : 10/754738
DATED : May 27, 2008
INVENTOR(S) : Mark Spencer Chamberlain It is certified that error appears in the above-identified patent and that said Letters Patent is hereby corrected as shown below:

Column 10

Lines 14-16, "battery bay aft of a portion of the airfoil while maintaining a balance point that enables the airfoil to achieve sustained flight." should read as --battery bay aft of a nose portion of the airfoil with shock-absorbing material between the battery and the nose portion of the airfoil while maintaining a balance point that enables the airfoil to achieve sustained flight--.

Signed and Sealed this

Twenty-eighth Day of July, 2009

John Doll

JOHN DOLL
*Acting Director of the United States Patent and Trademark Office*